US006689428B2

(12) United States Patent
Kao

(10) Patent No.: US 6,689,428 B2
(45) Date of Patent: Feb. 10, 2004

(54) ARTIFICIAL BARK FOR A DECORATIVE TREE

(75) Inventor: Cheung Chong Kao, Chai Wan (HK)

(73) Assignee: Boto (Licenses) Limited, Douglas (GB)

( * ) Notice: Subject to any disclaimer, the term of this patent is extended or adjusted under 35 U.S.C. 154(b) by 0 days.

(21) Appl. No.: 10/184,229

(22) Filed: Jun. 28, 2002

(65) Prior Publication Data

US 2004/0001923 A1 Jan. 1, 2004

(51) Int. Cl.[7] ..... A01N 3/00; A41G 1/00; B05D 5/00; B05D 3/02

(52) U.S. Cl. ..... 428/18; 428/16; 428/17; 428/24; 427/257; 427/372.2; 427/379; 427/402; 427/421; 427/427

(58) Field of Search ..... 428/16, 17, 18, 428/24; 427/257, 258, 261, 262, 372.2, 379, 402, 421, 427

(56) References Cited

U.S. PATENT DOCUMENTS 2,166,002 A * 7/1939 Fritsch ..... 428/18
5,611,176 A * 3/1997 Juengert et al. ..... 52/40
5,679,189 A * 10/1997 Jarboe ..... 156/61
6,117,503 A * 9/2000 Lee et al. ..... 428/18

* cited by examiner

*Primary Examiner*—Deborah Jones
*Assistant Examiner*—G. A. Blackwell-Rudasill
(74) *Attorney, Agent, or Firm*—Camille L. Urban; G. Brian Pingel

(57) ABSTRACT

The present invention provides an artificial bark for a decorative tree and a method of creating the material and applying it. The artificial bark includes an undercoat preferably made of a foamable plastic coating, a top coat also preferably made of a foamable plastic coating which is texturized, and a layer of colorant. The undercoat is applied to a structural member of the tree and then air dried. Then the top coat is applied, texturized by dragging a comb-like instrument across its surface, and air dried. Next, the undercoat and topcoat on the structural member are heat cured. Due to differences in the content of the undercoat and the top coat, heat curing causes the texture created in the top coat to be accentuated. After cooling, a colorant is applied to complete the artificial bark's resemblance to real tree bark.

17 Claims, 5 Drawing Sheets

ARTIFICIAL BARK FOR A DECORATIVE TREE

BACKGROUND OF THE INVENTION

1. Field of the Invention

The present invention relates in general to a decorative tree and, more specifically, to an artificial bark and method for providing said bark which includes the steps of applying a coating in semi-liquid form to a structural member of said artificial tree, heat treating, and painting.

2. Description of the Prior Art

It is known in the art to provide artificial trees which include artificial structural members such as branches and trunks. Prior art structural members may be plastic or steel and wrapped in artificial greenery or painted to resemble the color of bark. It is also known in the art to provide artificial trees which are, in essence, part artificial and part genuine. These trees typically include artificial branches and needles which are attached in some way to trunks which have been obtained from live trees.

The present invention differs from the above referenced inventions and others similar in that these prior devices either present a trunk that looks only remotely similar to a real trunk or, through the use of a real trunk, present problems for importation to the United States, pest control problems, durability challenges and fire hazards.

It is therefore one object of the present invention to provide a material and method of application of the material which, when applied to the surface of artificial structural members, results in a surface that highly resembles real tree bark.

It is another object of the present invention to provide artificial tree bark which does not harbor pests and, therefore, when applied to decorative trees, will be allowed as an import to the United States.

As final objectives, the present invention provides an artificial tree bark which is more durable and more fire resistant than real wood and bark.

SUMMARY

The present invention provides a material and a method for creating a surface coating on artificial structural members which looks remarkably like real bark on a real tree. For an artificial tree which uses steel tubes or other hard-surface structural members, an undercoat, which can be a foamable plastic coating, is applied to the clean structural member and air dried. A topcoat is applied next and a comb-like instrument is then used to texturize the topcoat to closely resemble the texture of real tree bark. The structural member and coating is air dried and then baked. Once cooled, paint similar to the color of bark is applied to the textured topcoat, such that the finished undercoat, topcoat and paint comprise artificial bark.

Prior to applying the undercoat to a structural member serving as a trunk, brackets may be affixed to the structural member which will facilitate the addition of branch members after the artificial bark is finished.

Other objects, features, and advantages of the present invention will be readily appreciated from the following description. The description makes reference to the accompanying drawings, which are provided for illustration of the preferred embodiment. However, such embodiment does not represent the full scope of the invention. The subject matter which the inventor does regard as his invention is particularly pointed out and distinctly claimed in the claims at the conclusion of this specification.

DESCRIPTION OF THE PREFERRED EMBODIMENT(S)

Figure 1:
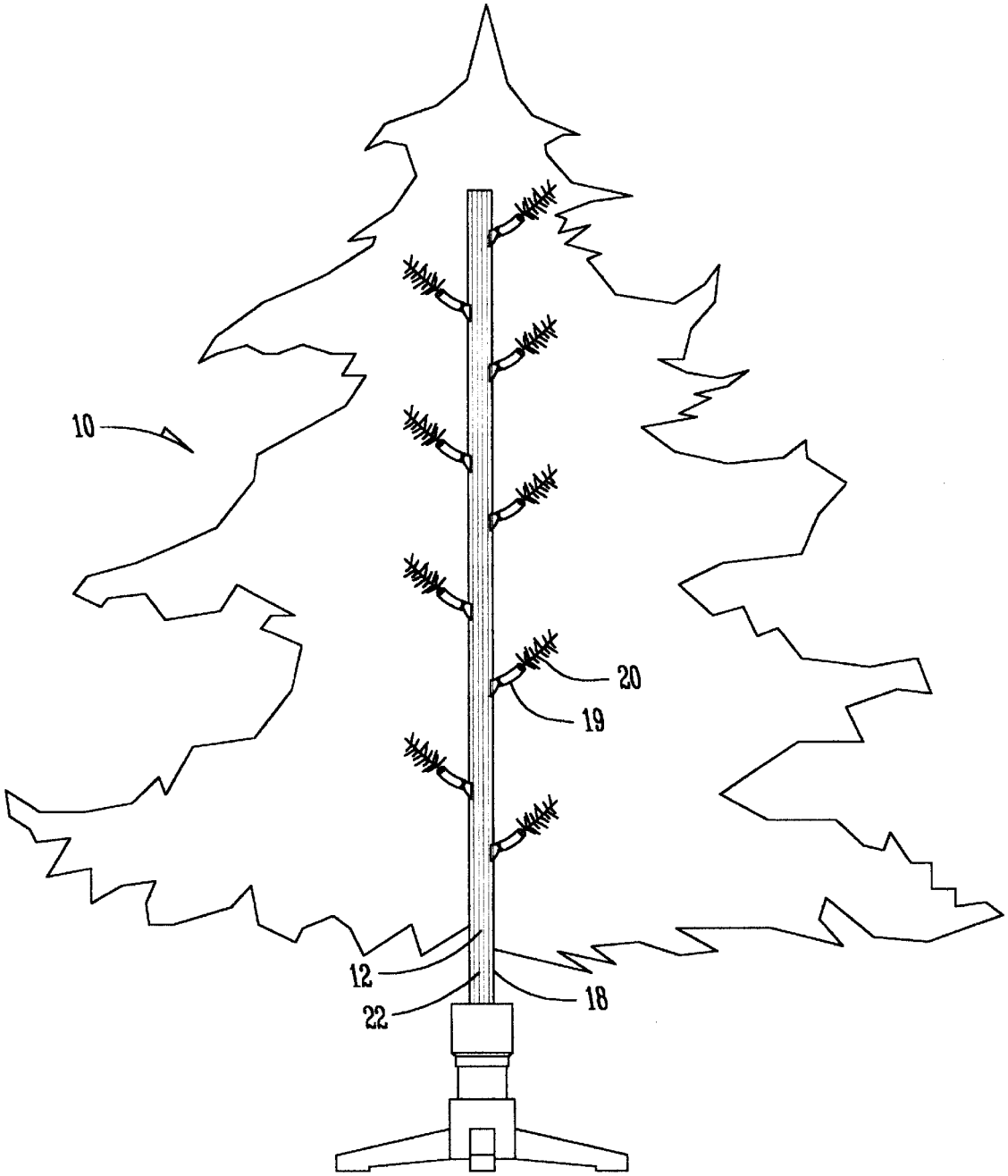
FIG. 1 is a perspective view of an artificial tree exhibiting the artificial bark of the present invention.
Figure 2:
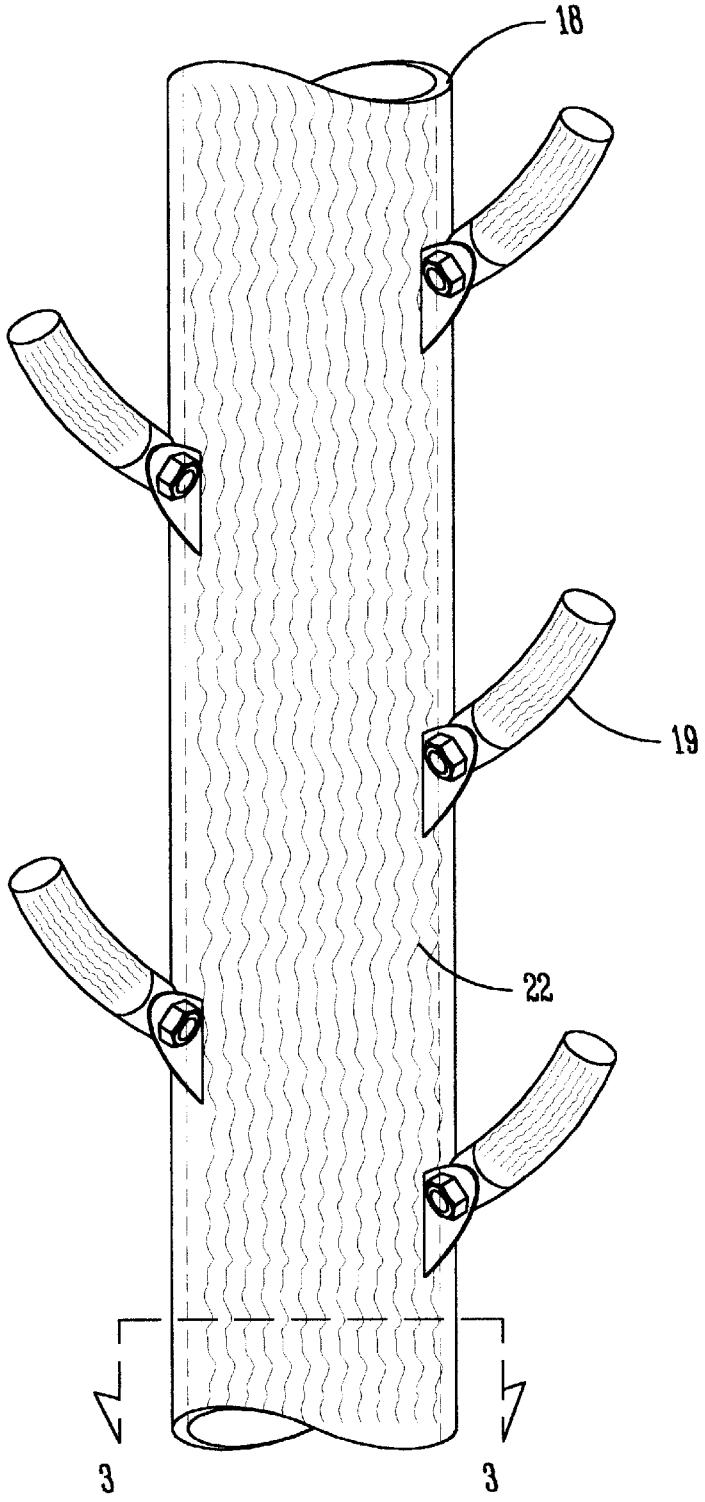
FIG. 2 is an enlarged view of a portion of the trunk of FIG. 1 showing brackets used to affix branch members to said artificial tree.
Figure 3:
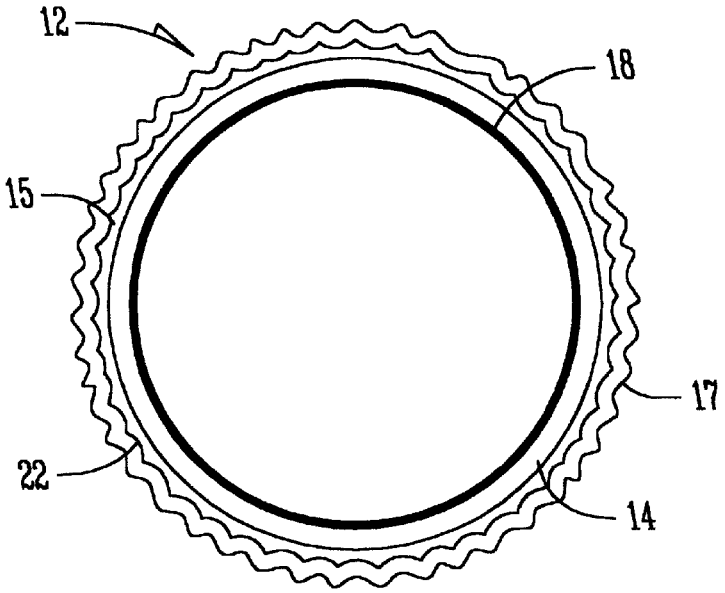
FIG. 3 is a cross section of the trunk and artificial bark of FIG. 2 shown along line 3—3.

An artificial tree 10 shown generally in FIG. 1 shows a preferred embodiment of the present invention, artificial tree bark 12. The tree bark 12 comprises an undercoat 14 and a topcoat 15 and colorant 17 on a structural member 16 (see also FIG. 3) of the tree 10. In FIG. 1, the structural members 16 such as a trunk member 18 and a plurality of bracket members 19 and a plurality of branch members 20 are shown with the artificial bark 12 applied. The bark 12 exhibits a texture 22 resembling bark of a real tree. In the preferred embodiment as best shown in FIG. 3, a layer of colorant 24 applied to topcoat 15 and the texture 22 completes the semblance to tree bark.

A method for providing artificial bark 12 comprises first applying the undercoat 14 of a first mixture by spraying. The first mixture comprises a paste material, water, and colorant. After the undercoat 14 is dried, the topcoat 15 of a second mixture is applied. The second mixture also comprises paste material, water, and colorant, however, the composition by weight of paste material is much higher than in said first mixture.

Figure 5:
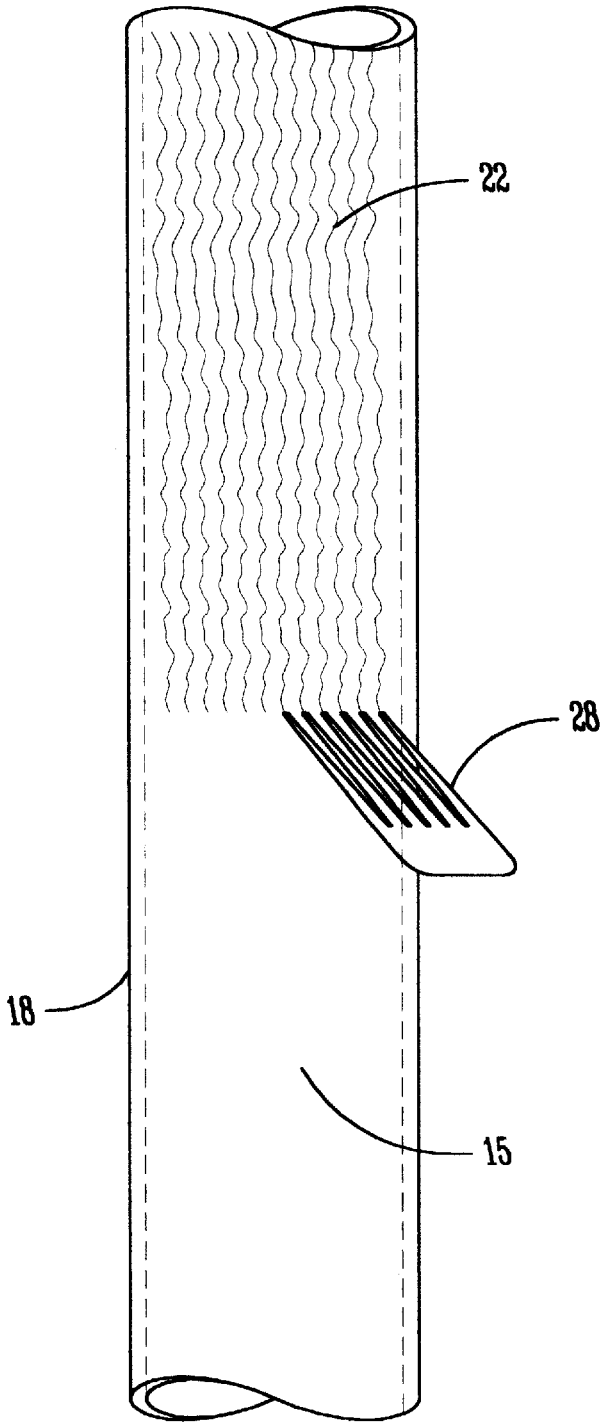
FIG. 5 is an illustration of the texturizing step.

Next, a comb-like member 28 is pulled lengthwise across the topcoat 15 to create a surface texture 22 which resembles texture of natural tree bark (See FIG. 5). After drying and curing, a layer of colorant 24 is applied to the texture 22 in a color resembling natural bark.

In the preferred embodiment, the paste material used in undercoat 14 and topcoat 15 is a foamable paste and, more specifically, a foamable paste sold under the trademark TH-688 Low Temperature Foamable Coating Paste and available from Chung Kong Trading Company Limited, Kwai Chung, Hong Kong. The undercoat 14 is made of a first mixture of TH688, water and colorant in composition by weight of 200:50:1. The topcoat 15 is made of a second mixture of TH688, water and colorant in composition by weight of 2000:40:3. However, neither the specific type of paste material employed nor the composition by weight is critical to the present invention as long as the undercoat 14 and topcoat 15 can be applied and texturized and the texture will remain substantially permanent after curing. The advantage of using coats with differing compositions is that upon curing the undercoat will foam to a lesser degree than the topcoat providing a rougher, more natural looking texture.

Figure 4:
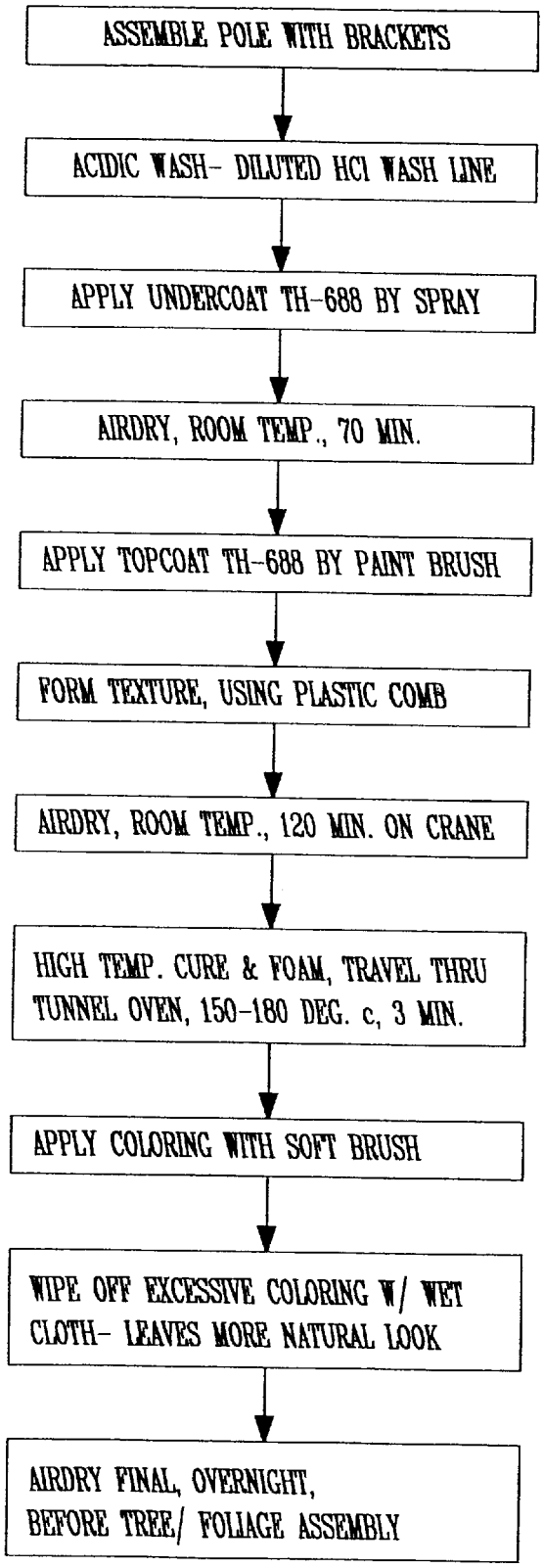
FIG. 4 is a flow chart depicting the steps and process of applying the artificial bark of the present invention.

In the method of the preferred embodiment shown in FIG. 4 as a flow chart, the first step comprises assembling the trunk member 18 and brackets 19 and rust, oil, and dirt is removed by an acid wash of diluted hydrochloric acid applied by a wash line. The undercoat 14 is applied with a sprayer and air-dried at room temperature for about 70 minutes. Then, the topcoat 15 is applied with a brush and texture 22 is created using a relatively course brush as the comb-like member 28 which is pulled lengthwise across the topcoat 15 to create grooves and the textured appearance needed to resemble natural tree bark. The texture 22 and topcoat 15 are air dried for about 120 minutes at room temperature. The curing step of the preferred embodiment is next and includes heating the coated 14 and 15 and texturized 22 trunk member 18 and brackets 19 to about 150–180 Celsius degrees for around 3 minutes while it is moved through a tunnel oven. Once cooled, colorant 24 is either brushed or sprayed on the now textured and hardened topcoat 15 and excess colorant 24 is removed by wiping with a wet cloth which provides color variation necessary to resemble tree bark.

Thus, the present invention has been described in an illustrative manner. It is to be understood that the terminology that has been used is intended to be in the nature of words of description rather than of limitation.

Many modifications and variations of the present invention are possible in light of the above teachings. For example, colorant could be added to the coating before it is applied. Therefore, within the scope of the appended claims, the present invention may be practiced otherwise than as specifically described.

What I claim is:

1. A decorative tree with artificial bark comprising;

a) a structural member of said artificial tree;

b) an undercoat comprising a ratio of paste material to water adhered to said structural member;

c) a topcoat comprising a ratio of paste material to water which is larger than that of said undercoat and applied over said undercoat and having an exposed side wherein said exposed side comprises texture resembling natural tree bark; and d) a colorant layer on said topcoat resembling natural tree bark.

2. A decorative tree as claimed in claim 1 wherein said structural member comprises a trunk member made of a steel cylinder.

3. A decorative tree as claimed in claim 2 wherein said trunk member further comprises brackets upon which can be mounted a plurality of additional structural members of said artificial tree to serve as branch members.

4. A decorative tree as claimed in claim 3 wherein said paste material of said undercoat comprises low temperature foamable coating paste.

5. A decorative tree as claimed in claim 1 wherein said layer of colorant comprises paint applied to said texture.

6. A decorative tree as claimed in claim 3 wherein said undercoat further comprises a colorant, said topcoat further comprises a colorant and said paste material further comprises a foamable paste.

7. A method for providing artificial bark for the decorative tree claimed in claim 1 comprising;

a) a first application step comprising applying said undercoat on said structural member;

b) a first drying step comprising air drying;

c) a second application step wherein said topcoat is applied to said undercoat and a texturizing step wherein said topcoat is provided the appearance of tree bark by pulling a comb-like member across said topcoat;

d) a second drying step;

e) curing by heating at around 150–180 degrees Celsius for about 3 minutes;

f) adding color by applying said layer of colorant to said topcoat and removing excess colorant.

8. A method for providing artificial bark as claimed in claim 7 wherein said undercoat comprises low temperature foamable coating paste, water, and colorant wherein the composition by weight of said topcoat comprises a larger weight of low temperature foamable coating paste than does the composition by weight of said undercoat.

9. A method for providing artificial bark as claimed in claim 7 wherein said first drying step comprises air drying at room temperature for about 70 minutes.

10. A method for providing artificial bark as claimed in claim 7 wherein said second drying step comprises air drying at room temperature for about 120 minutes.

11. A method for providing artificial bark as claimed in claim 7 wherein said curing further comprises movement through a tunnel oven.

12. A method for providing artificial bark as claimed in claim 7 wherein said first application step comprises spraying said undercoat and said second application step comprises brushing on said topcoat.

13. A method for creating an artificial bark for the decorative tree claimed in claim 1 including said undercoat further comprising a foamable paste applied on said structural member of said decorative tree, drying said undercoat, applying said topcoat further comprising a foamable paste, texturizing said top coat by pulling a comb-like member across said topcoat, a drying said topcoat, curing said undercoat and said topcoat by heating to about 150–180 degrees Celsius for up to 7 minutes by movement through a tunnel oven, and coloring said topcoat by brushing on a layer of colorant and then removing any excess with a wet cloth.

14. A method for providing artificial bark as claimed in claim 13 wherein said foamable paste is low temperature foamable coating paste and said undercoat include said low temperature foamable coating paste, water, and colorant in composition by weight of 200:50:1.

15. A method for providing artificial bark as claimed in claim 14 wherein said topcoat includes low temperature foamable coating paste, water, and colorant in composition by weight of 2000:40:3.

16. A method for providing artificial bark as claimed in claim 14 wherein said structural member is a trunk member made of steel pipe.

17. A method for providing artificial bark as claimed in claim 16 wherein said trunk member further comprises spaced apart brackets with means for attaching a plurality of branch members.

* * * * *